United States Patent [19]

Severs et al.

[11] Patent Number: 4,598,511

[45] Date of Patent: Jul. 8, 1986

[54] EARTH ANCHOR

[75] Inventors: Christopher W. Severs, Peckville; William L. Leonard, Tobyhanna, both of Pa.

[73] Assignee: Cooper Industries, Inc., Houston, Tex.

[21] Appl. No.: 694,090

[22] Filed: Jan. 23, 1985

[51] Int. Cl.[4] ..... E02D 5/80

[52] U.S. Cl. ..... 52/157

[58] Field of Search ..... 52/157, 153, 155, 156, 52/158, 23

[56] References Cited

U.S. PATENT DOCUMENTS

| | | | |
|---|---|---|---|
| 3,016,117 | 1/1962 | Petersen | 52/157 |
| 3,645,055 | 2/1972 | Rosa | 52/157 |
| 3,710,523 | 1/1973 | Taylor | 52/157 |
| 4,316,350 | 2/1982 | Watson | 52/157 |

FOREIGN PATENT DOCUMENTS

| | | | |
|---|---|---|---|
| 692569 | 8/1965 | Italy | 52/157 |
| 869339 | 5/1961 | United Kingdom | 52/157 |

*Primary Examiner*—J. Karl Bell

*Attorney, Agent, or Firm*—Nelson A. Blish; Eddie E. Scott; Alan R. Thiele

[57] ABSTRACT

An earth anchor including a helically shaped blade including a non-linear leading edge, and in which the principle longitudinal axis of the shaft of the anchor is laterally offset from the central longitudinal axis of the helical blade.

5 Claims, 3 Drawing Figures

EARTH ANCHOR

BACKGROUND OF THE INVENTION

This invention relates to earth anchors. More particularly, the invention relates to screw type earth anchors. Typically, these earth anchors include an augerlike one-piece helically-shaped blade having a sharpened leading edge attached to a shaft, such as by welding. The shaft is typically provided with means for being rotated either manually or by machine to effect engagement of the anchor into the earth. Anchors representative of this design are those disclosed in U.S. Pat. Nos. 3,016,117; 3,645,055; and 3,710,523. It is well known in the art, that while screw anchors of this design do engage themselves in the earth, and are effective in anchoring a member, they are subject to certain shortcomings, one of which requires the application of high torsional forces to the shaft of the anchor so that the blade will cut through the earth. High installation torsional forces are obviously undesirable in that, among other things, larger, more expensive power drive tools are required, and higher stresses are imposed on the anchor. High installation torsional forces are particularly undesirable in the case of manually installed anchors in that in some situations the forces may be sufficiently high so as to preclude complete or proper installation of the anchor. The blades of these anchors are most often welded to the shaft and the torsional forces impose high stresses on the weld. The stresses are concentrated primarily at the junction of the leading edge of the blade and shaft. These high stress concentrations frequently cause failure of the weld with resultant detachment of the blade from the shaft, or result in an undetected weak anchor that can fail in service.

Another shortcoming common with screw type anchors is the imposition of high loads on the generally unsupported trailing edge of the blade by the attached structure after insertion into the ground. The longitudinal forces exerted on the anchor shaft create a bending moment on the trailing edge portion of the blade that can cause the blade to bend or deflect with resultant loss of holding power.

Heretofore, it has been common to reduce required installation torsional force by curving the leading edge of the blade in a spiral fashion, such as that shown in the above-mentioned patents. The curved leading edge reduces reaction moments over the length of the leading edge which in turn reduces the overall required installation torque.

The earth anchor disclosed in U.S. Pat. No. 3,710,523, in addition to employing a curved leading edge, employs a pair of diametrically opposed radially enlarged portions to the blade which help counteract loss of engagement with the earth as the shaft of the arbor is caused to tilt under the forces exerted by the anchored member. While this anchor design helps counteract the tendency of the anchor to tilt within the soil, the bending moments placed on the trailing edge of each of the blades, due to axial forces on the shaft, has for the most part, not been reduced. It can therefore be appreciated that it would be highly desirable to provide for an earth anchor that lessens the required installation torsional force still further from the present state of the art, and also provides increased holding force when the anchor is installed by reducing the bending moments on the trailing edge of the blade. Further, it would be highly desirable to provide for an earth anchor that reduces the possibility of the blade becoming detached from the shaft during installation by reducing stress concentrations at the interface of the blade and shaft.

SUMMARY OF THE INVENTION

Accordingly, a preferred aspect of the invention provides for a helically shaped blade attached to a hub, with the principle longitudinal axis of the hub laterally offset from the central longitudinal axis of the helically shaped blade.

According to another aspect of the invention, the blade of the earth anchor is provided with a curved leading edge.

BRIEF DESCRIPTION OF THE DRAWINGS

The present invention will be better understood after a reading of the following detailed description taken in conjunction with the drawings wherein.

DETAILED DESCRIPTION OF THE PREFERRED EMBODIMENT

Figure 1:
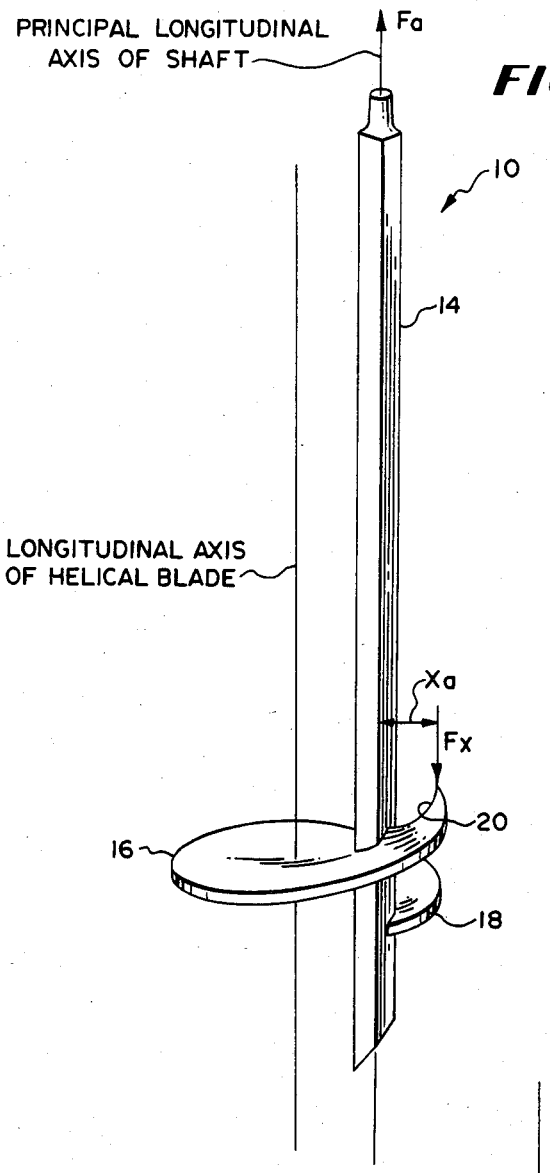
FIG. 1 is a perspective view of a preferred embodiment of an earth anchor employing the principles of the present invention.
Figure 2:
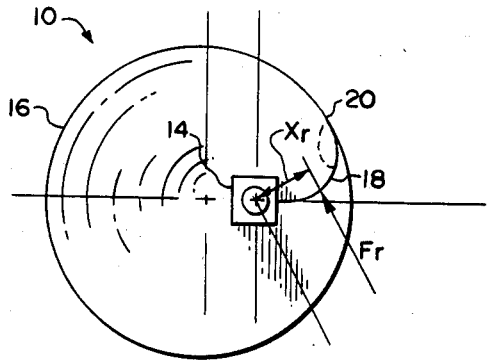
FIG. 2 is a plan view of the earth anchor of FIG. 1, showing the principle longitudinal axis of the shaft laterally offset from the central longitudinal axis of the blade.

Shown in FIG. 1 is an earth anchor 10, including a hub 12, shown in the form of an elongated shaft 14 having a helically shaped blade 16 welded to the shaft proximate one end. The cross-sectional shape of the shaft is shown as being square, but is to be considered representative of only one acceptable shape. Those skilled in the art can readily devise other shaft configurations, for example, a circular shaft, and those other configurations are to be considered to be within the scope of the invention The shaft is preferably sharpened at the end which enters the ground to facilitate entry and advancement of the anchor. The blade 16 is helically shaped and can have any number of convolutes as desired. The blade of the present embodiment is shown as including one 360° convolute and is to be considered as representative only. The blade 16 can also have any peripheral shape, as viewed from the top, including, for example, a generally rectangular, square, oblong or the circular shape, as shown in FIG. 2. As stated, the blade 16 is a helix, that is generated about a central longitudinal axis, as shown best in FIGS. 1 and 2. It can be seen that the central longitudinal axis about which the helical shape is generated is coincident with the principle longitudinal axis of the blade.

According to an important aspect of the invention, the leading edge 18 of the blade 16 is non-linear and spirals outwardly from the shaft 14 or hub 12 to the periphery of the blade. If desired, the leading edge 18, which functions as the cutting edge of the blade, can be sharpened. Many non-linear shapes of the leading edge are available, and those skilled in the art can readily devise a shape suitable for use with the helical blade. The periphery of the blade fully encircles the shaft 14, and terminates in a trailing edge 20 that has a non-linear shape complimentary to the shape of the leading edge 18, as shown in FIGS. 1 and 2.

According to another important aspect of the invention, the principle longitudinal axis of the shaft 14 is positioned parallel to and laterally offset from the central longitudinal axis of the helical blade in a direction toward the leading and trailing edges. As shown best in FIG. 2, by locating the principle longitudinal axis of the shaft laterally offset from the central longitudinal axis of the blade in close proximity to the leading edge 18, the reaction moment arm Xr, as measured from the point of application of any given reaction force $F_r$ on the leading edge 18 to the center of the shaft 14, which is also the axis of rotation of the blade, is reduced from the reaction moment art that results if the longitudinal axis of the shaft were located coincident with the central longitudinal axis of the blade, as is presently done in the prior art anchors. It is well known that the total torsional installation reaction moment on the leading edge 18 is equal to the summation of all of the individual reaction moments $(F_r)$ $(X_r)$ along the leading edge. Therefore, by reducing the individual moment arms $X_r$, the total reaction moment is also reduced. It can be appreciated that for a given size helical blade, the total torsional force that must be applied to the shaft of the anchor of the present invention to effect cutting of the earth by the leading edge and installation of the anchor is substantially reduced from that required to install a prior art anchor in which the shaft and axis of rotation are positioned at the center of the blade. The reduction in installation torque achieved due to the offset blade and shaft structure is in addition to any reduction due solely to the curved leading edge structure, and provides for an anchor that is more easily installed than one that employs only a curved leading edge.

Figure 3:
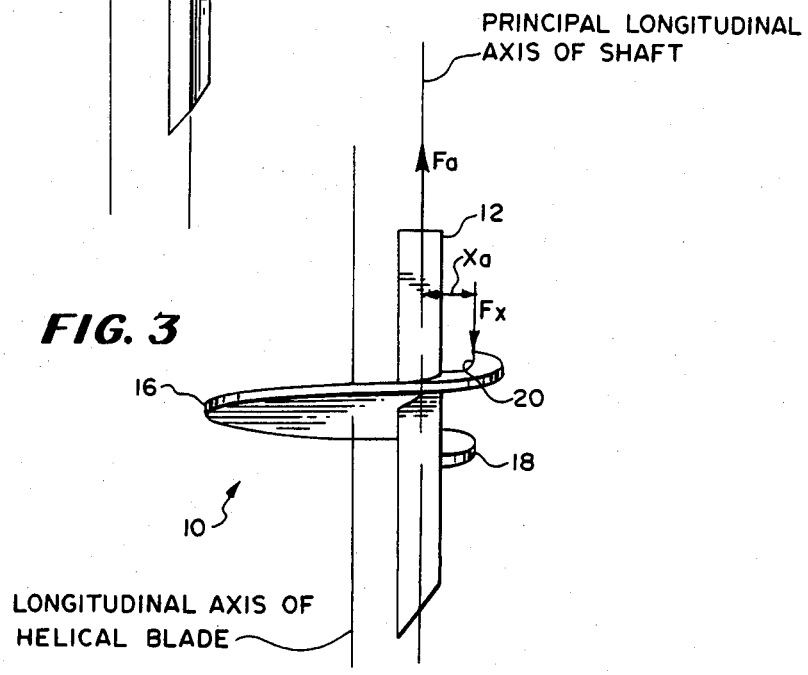
FIG. 3 is a front elevational view of the earth anchor of FIG. 1, showing details of construction.

The trailing edge of a helically shaped blade is typically substantially unsupported, as shown in FIGS. 1 and 3, and an upwardly directed axial force $F_a$ imposed on the shaft of the anchor by the anchored member, not shown, secured thereto creates an axial reaction force $F_x$ on the trailing edge of the blade. The reaction force $F_x$ has a corresponding moment arm $X_a$ as measured from the center of the shaft to the point of application of the axial reaction force $F_x$. The total resultant bending moment $(F_x)$ $(X_a)$ imposed on the trailing edge 20 is equal to the summation of all of the individual reaction moments along the trailing edge. The present invention reduces the total bending moment $(F_x)$ $(X_a)$ imposed on the trailing edge of a given size blade and reduces the probability that the trailing edge will bend or deflect by reducing the moment arm $X_a$. It can be appreciated that the reduction in the moment arm $X_a$ is accomplished by locating the principle longitudinal axis of the shaft laterally offset from the central longitudinal axis of the helical blade in a direction toward and in close proximity to the location of the trailing edge.

A further advantageous result of the structure disclosed herein lies in the fact that the distribution of the stresses imposed on the weld between the blade and shaft are more uniformly distributed around the shaft, rather than being concentrated at the point of intersection of the leading edge with the shaft.

Also, the offset location of the shaft relative to the central longitudinal axis of the blade allows the blade to be gradually pushed away from obstacles or conversely to push obstacles encountered clear of the advancing blade, which pushing action takes place over approximately 120° of rotation of the blade.

Having described the details of construction and advantageous features of the invention, those skilled in the art having the benefit of the description and the accompanying drawings can readily devise other modifications and embodiments. Therefore, said other modifications and embodiments are to be considered to be within the scope of the appended claims.

We claim:

1. An earth anchor comprising:

a hub having a principle longitudinal axis; and a helically shaped blade having a leading edge, a trailing edge, and a central longitudinal axis about which said helical shape is generated, said blade affixed to said hub with the principle longitudinal axis of said hub laterally offset a predetermined amount from the central longitudinal axis of said helical shape toward said leading edge with said principal longitudinal axis of said hub, said central longitudinal axis of said helical shape of said helically shaped blade and said leading edge being generally aligned.

2. The earth anchor as defined in claim 1, wherein said hub is an elongated shaft and said blade is affixed to said shaft proximate one end thereof.

3. The earth anchor as defined in claim 1, wherein said leading edge has a non-linear shape.

4. The earth anchor is defined in claim 3 wherein said trailing edge has a non-linear shape that is substantially complimentary to the shape of said leading edge.

5. The earth anchor as defined in claim 4 wherein said blade comprises at least one 360 degree convolute.

* * * * *